US009938786B2

(12) United States Patent
Lauderdale et al.

(10) Patent No.: US 9,938,786 B2
(45) Date of Patent: Apr. 10, 2018

(54) STRING INDEXING DEVICE TO PREVENT INADVERTENT TOOL OPERATION WITH A STRING MOUNTED OPERATING DEVICE

(71) Applicant: BAKER HUGHES INCORPORATED, Houston, TX (US)

(72) Inventors: Donald P. Lauderdale, Cypress, TX (US); Michael S. Bailey, Spring, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 565 days.

(21) Appl. No.: 14/576,557

(22) Filed: Dec. 19, 2014

(65) Prior Publication Data

US 2016/0177632 A1 Jun. 23, 2016

(51) Int. Cl.
*E21B 23/00* (2006.01)
*E21B 34/12* (2006.01)

(52) U.S. Cl.
CPC ..... *E21B 23/006* (2013.01)

(58) Field of Classification Search
CPC .. E21B 34/14; E21B 23/006; E21B 2034/002; E21B 2034/007; E21B 23/00; E21B 23/02; E21B 34/12
See application file for complete search history.

(56) References Cited

U.S. PATENT DOCUMENTS 3,494,419 A * 2/1970 Mullins ..... E21B 23/006 166/150
4,917,191 A 4/1990 Hopmann et al.
4,928,772 A 5/1990 Hopmann
4,964,460 A * 10/1990 Armell ..... E21B 23/006 166/113
5,549,161 A 8/1996 Gomez et al.
5,636,694 A 6/1997 Mireles, Jr. et al.
5,678,633 A 10/1997 Constantine, Jr.
5,765,640 A 6/1998 Milne et al.
7,556,102 B2 7/2009 Gomez
7,562,703 B2 7/2009 Palmer et al.
2002/0066573 A1* 6/2002 Patel ..... E21B 34/10 166/374
2004/0238173 A1* 12/2004 Bissonnette ..... E21B 34/14 166/307
2008/0257557 A1* 10/2008 Cowie ..... E21B 33/063 166/373
2011/0011597 A1* 1/2011 Fay ..... E21B 23/006 166/373

(Continued)

*Primary Examiner* — Kipp C Wallace
(74) *Attorney, Agent, or Firm* — Steve Rosenblatt

(57) ABSTRACT

An indexing tool is incorporated into a tubular string. The indexing tool is intended to function as a variable travel stop so that on initial landing other tools associated with the string will not extend to an operating position for tools that would otherwise operate on contact with relative movement. The indexing device can prevent a shifting device from engaging a valve operator when the index device initially lands on a support either during normal operation or in an emergency such as when shear rams have cut the string to allow it to fall so that a blowout preventer can be operated to engage opposed rams. In such an emergency the barrier valve operator will not be actuated and the string is later fished with the barrier valve closed. A pickup and set down force then allows the barrier valve to open when desired.

19 Claims, 8 Drawing Sheets

(56) References Cited

U.S. PATENT DOCUMENTS

| | | | | |
|---|---|---|---|---|
| 2011/0048723 | A1* | 3/2011 | Edwards | E21B 43/04 166/319 |
| 2011/0083857 | A1* | 4/2011 | Knobloch, Jr. | E21B 34/12 166/373 |
| 2013/0025882 | A1* | 1/2013 | Streich | E21B 41/00 166/381 |
| 2013/0340832 | A1* | 12/2013 | Lauderdale | F16K 37/0058 137/2 |
| 2016/0273291 | A1* | 9/2016 | Scott | E21B 43/04 |
| 2016/0326835 | A1* | 11/2016 | Trahan | E21B 23/006 |

* cited by examiner

STRING INDEXING DEVICE TO PREVENT INADVERTENT TOOL OPERATION WITH A STRING MOUNTED OPERATING DEVICE

FIELD OF THE INVENTION

The field of the invention is string mounted tool operating devices and more particularly an accessory device that prevents tool operation on initial landing on the tool or its operator.

BACKGROUND OF THE INVENTION

Production packers are typically provided with barrier valves or zone isolation valves. Typically these valves have an associated operator that is engaged by a cooperating tool such that when running in the valve is opened and when pulling back through the valve, the valve closes. One such valve is shown in U.S. Pat. No. 8,443,894. Other shifting tools are illustrated in U.S. Pat. Nos. 5,636,694; 5,765,640; 7,562,703; 7,556,102; 5,678,633; 5,636,694; 5,549,161; 4,928,772; 4,917,191.

One potential issue with such tools is that situations can occur when the string needs to be cut with shear rams in a blowout preventer such as in occasions when the rig has to move off an offshore wellhead in an emergency situation. When that happens the string is allowed to fall when it is cut. If the operating tool on the string is above the barrier valve operator then the barrier valve could potentially be operated to open upon contact of the operating tool that is on the string with the operator for the barrier valve. Since there is already an emergency condition that has caused this sequence of events, it would be undesirable to open the barrier valve which can magnify the potential dangers at such a time. What is needed and provided by the present invention is a device that prevents actuation of the tool on initial contact and allows subsequent tool operation by manipulation of the string to reconfigure the newly added tool to the string in a manner that will then allow the downhole to be selectively operated. In the preferred embodiment a j-slot indexing tool in tandem with associated travel stops is incorporated into the string that stops initial contact with the tool to be operated at a point short of tool operation. In this configuration a pin is in a short slot and an operating tool for the barrier valve actuator comes up short of the actuator when supported by the packer or polished bore receptacle. A subsequent picking up and setting down puts a pin in a longer slot and allows additional travel for the operating tool to reach the barrier valve actuator for opening the valve. Having this indexing tool as part of the string prevents inadvertent opening of a barrier valve if the string is cut by rams and allowed to drop. The cut string can later be fished with the barrier valve closed. While application to a barrier valve associated with a production packer is the preferred application, other applications where an emergency situation could result in a string being dropped in the hole and a tool in the hole being inadvertently operated are other applications that can benefit from the present invention. These and other aspects of the present invention will be more readily apparent to those skilled in the art from a review of the description of the preferred embodiment and the associated drawings while understanding that the full scope of the invention is to be found in the appended claims.

SUMMARY OF THE INVENTION

An indexing tool is incorporated into a tubular string. The indexing tool is intended to function as a variable travel stop so that on initial landing other tools associated with the string will not extend to an operating position for tools that would otherwise operate on contact with relative movement. The indexing device can prevent a shifting device from engaging a valve operator when the index device initially lands on a support either during normal operation or in an emergency such as when shear rams have cut the string to allow it to fall so that a blowout preventer can be operated to engage opposed rams. In such an emergency the barrier valve operator will not be actuated and the string is later fished with the barrier valve closed. A pickup and set down force then allows the barrier valve to open when desired.

DETAILED DESCRIPTION OF THE PREFERRED EMBODIMENT

Figure 1:
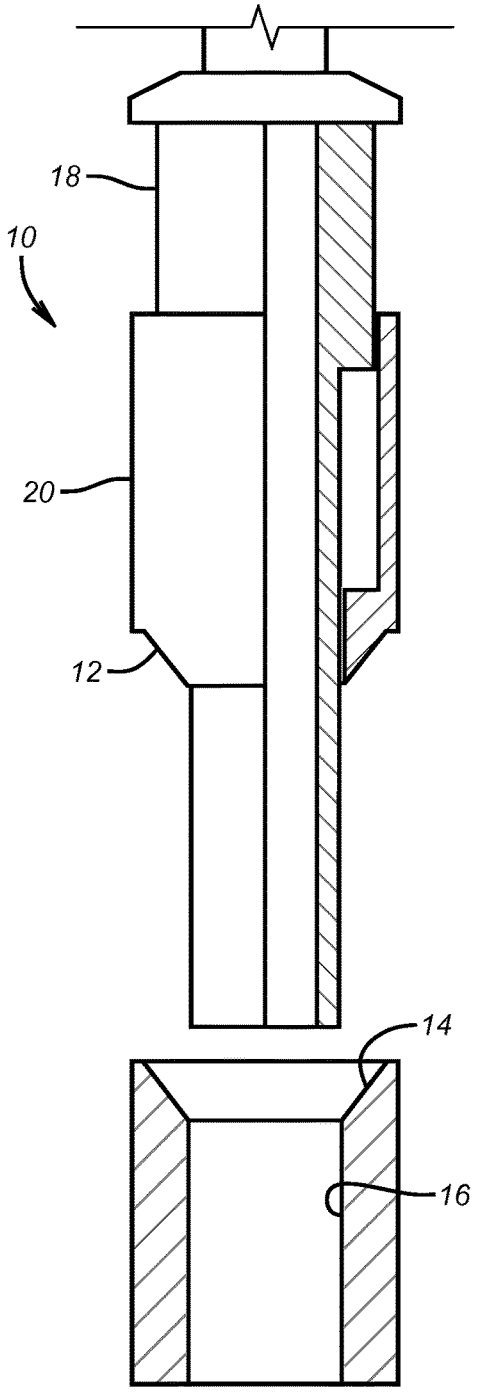
FIG. 1 shows the indexing locator suspended above a landing location.
Figure 2:
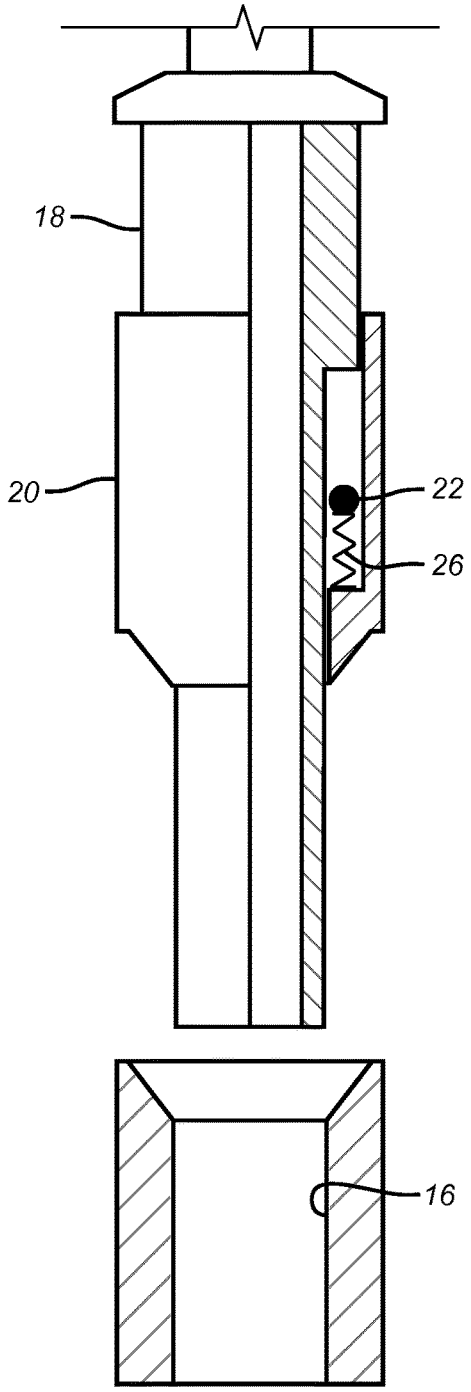
FIG. 2 is the view of FIG. 1 showing the landing location as a polished bore receptacle on a production packer.
Figure 3:
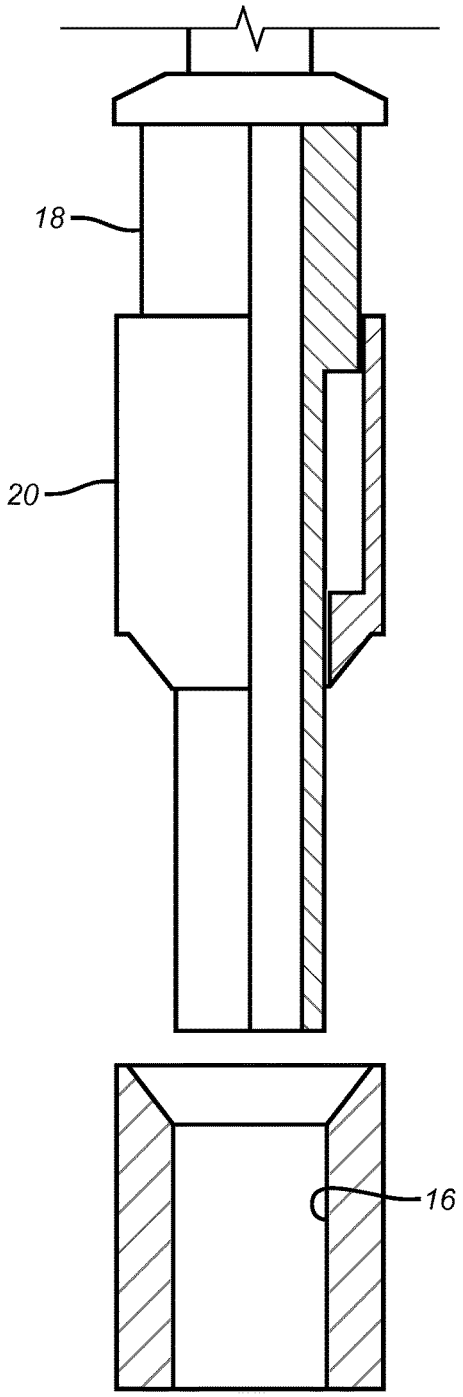
FIG. 3 is the view of FIG. 1 showing the high landing orientation of the indexing device.
Figure 4:
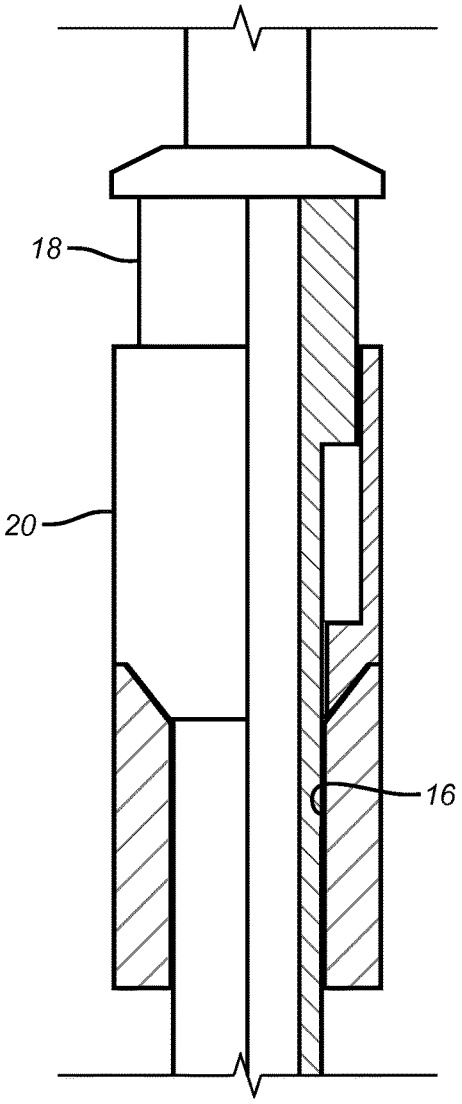
FIG. 4 is the view of FIG. 3 with the indexing device landed.

Referring to FIG. 1 the indexing locator 10 has a landing shoulder 12 that lands on a travel stop 14. The preferred application has the travel stop 14 as part of a production packer (not shown) and has a polished bore receptacle 16. As shown in FIG. 2 the locator 10 has a body 18 and a surrounding outer housing 20. A pin 22 moves in a preferably continuous slot 24 which is shown rolled flat in FIG. 7. A biasing device such as a spring 26 is compressed when weight is set down on body 18 and expands when body 18 is raised up so that the pin 22 can move along the slot 24 as seen in comparing FIGS. 7-11.

Figure 7:
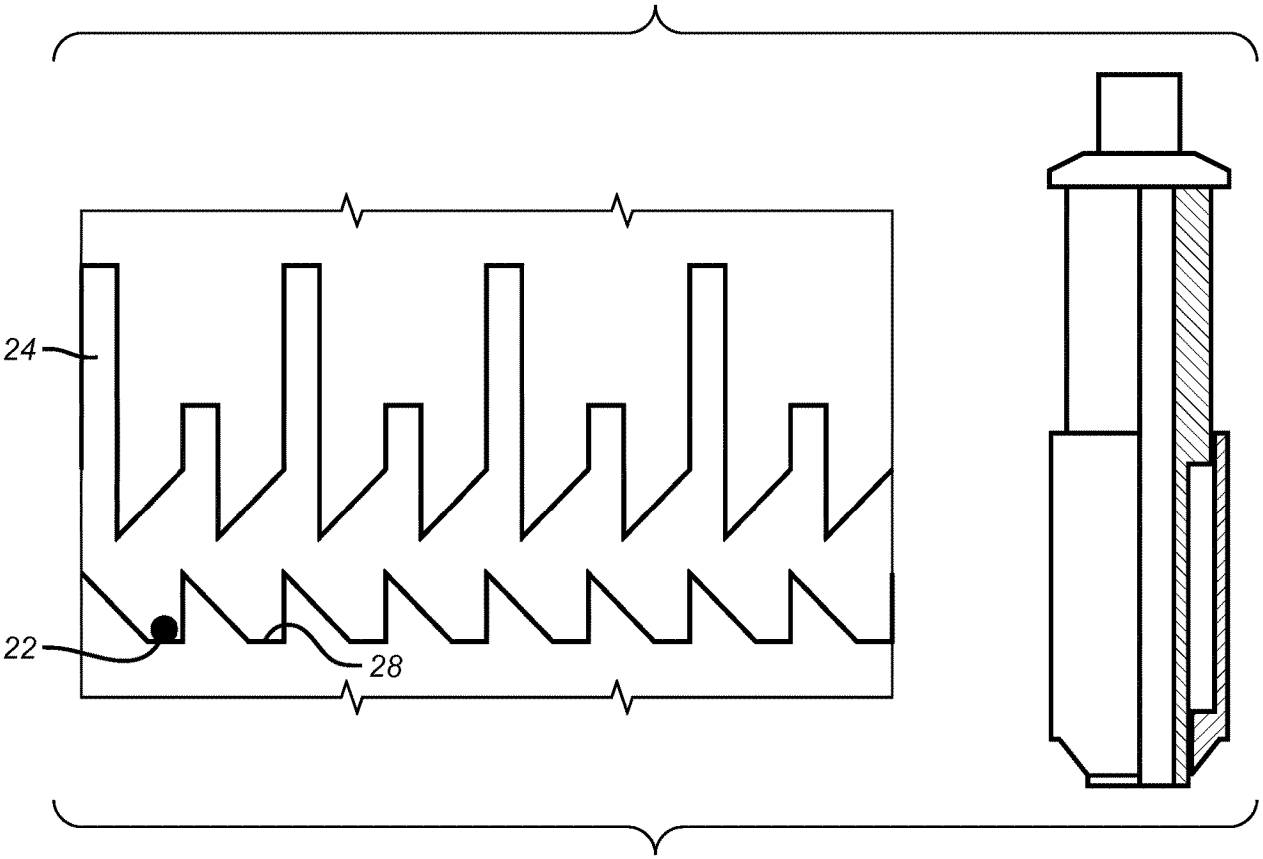
FIG. 7 is a rolled flat view of the j-slot assembly corresponding to the indexing device being suspended.
Figure 8:
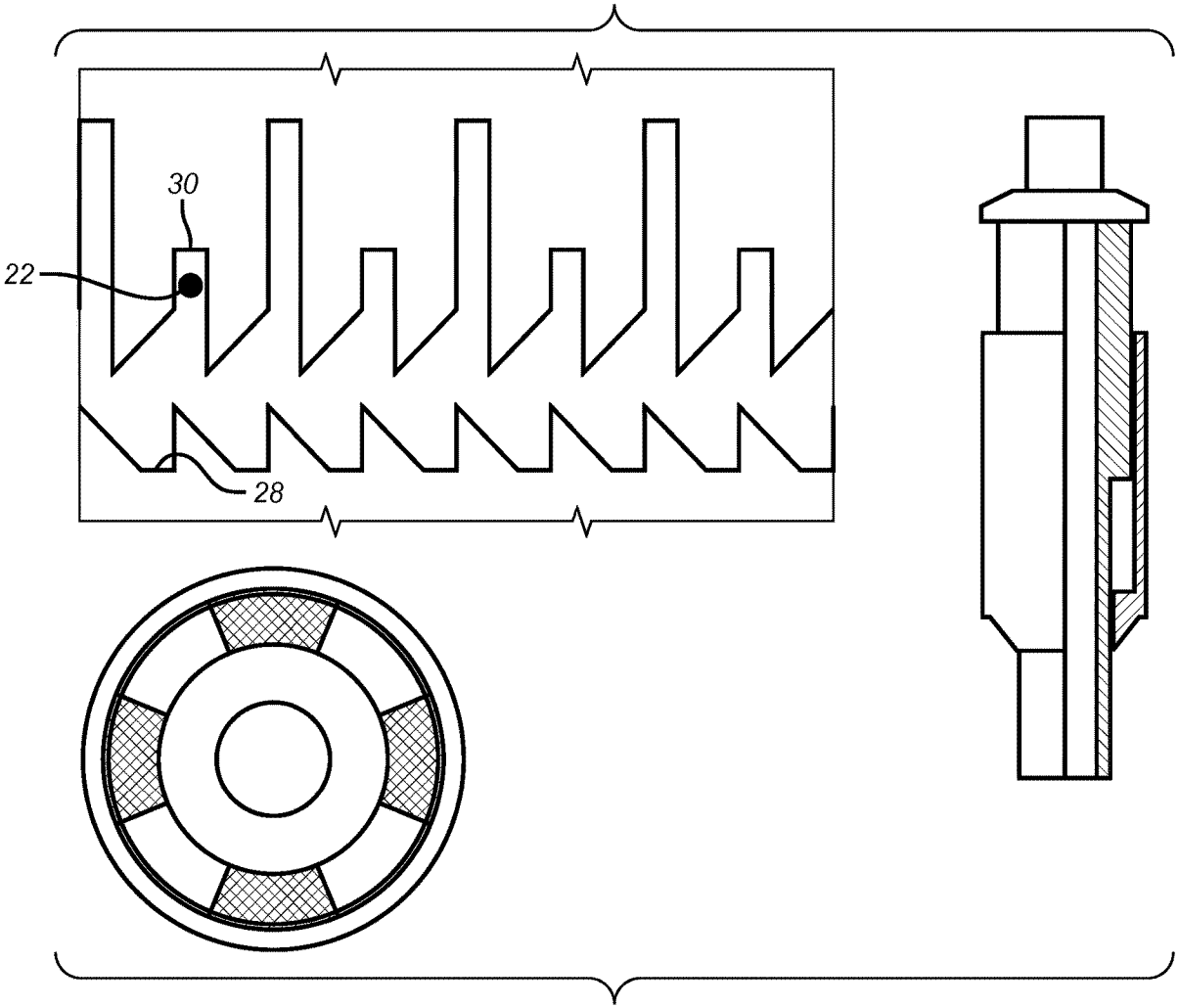
FIG. 8 is the view of FIG. 7 with weight set down and the indexing device in the high position.
Figure 9:
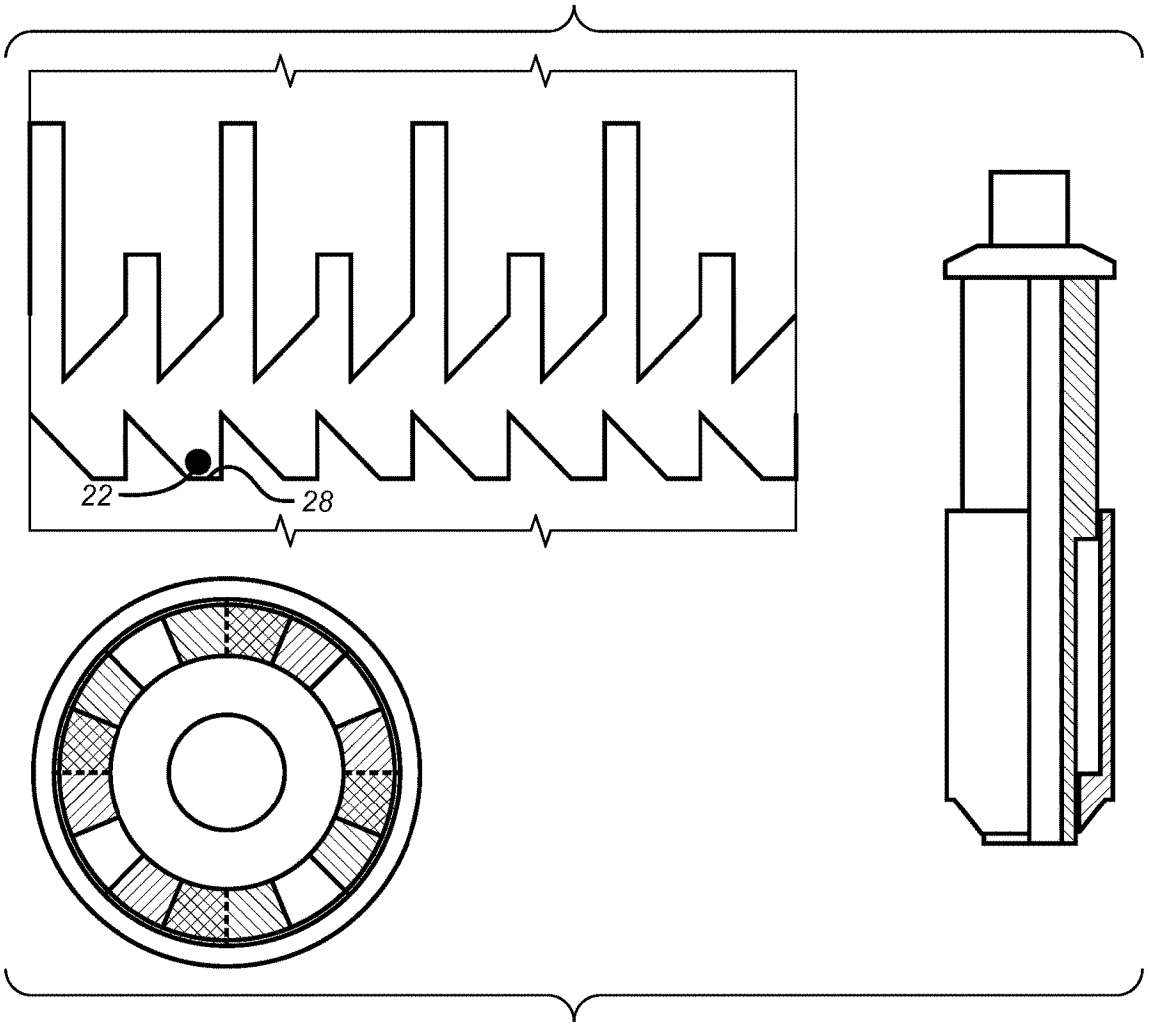
FIG. 9 is the view of FIG. 8 with the indexing tool picked up.
Figure 10:
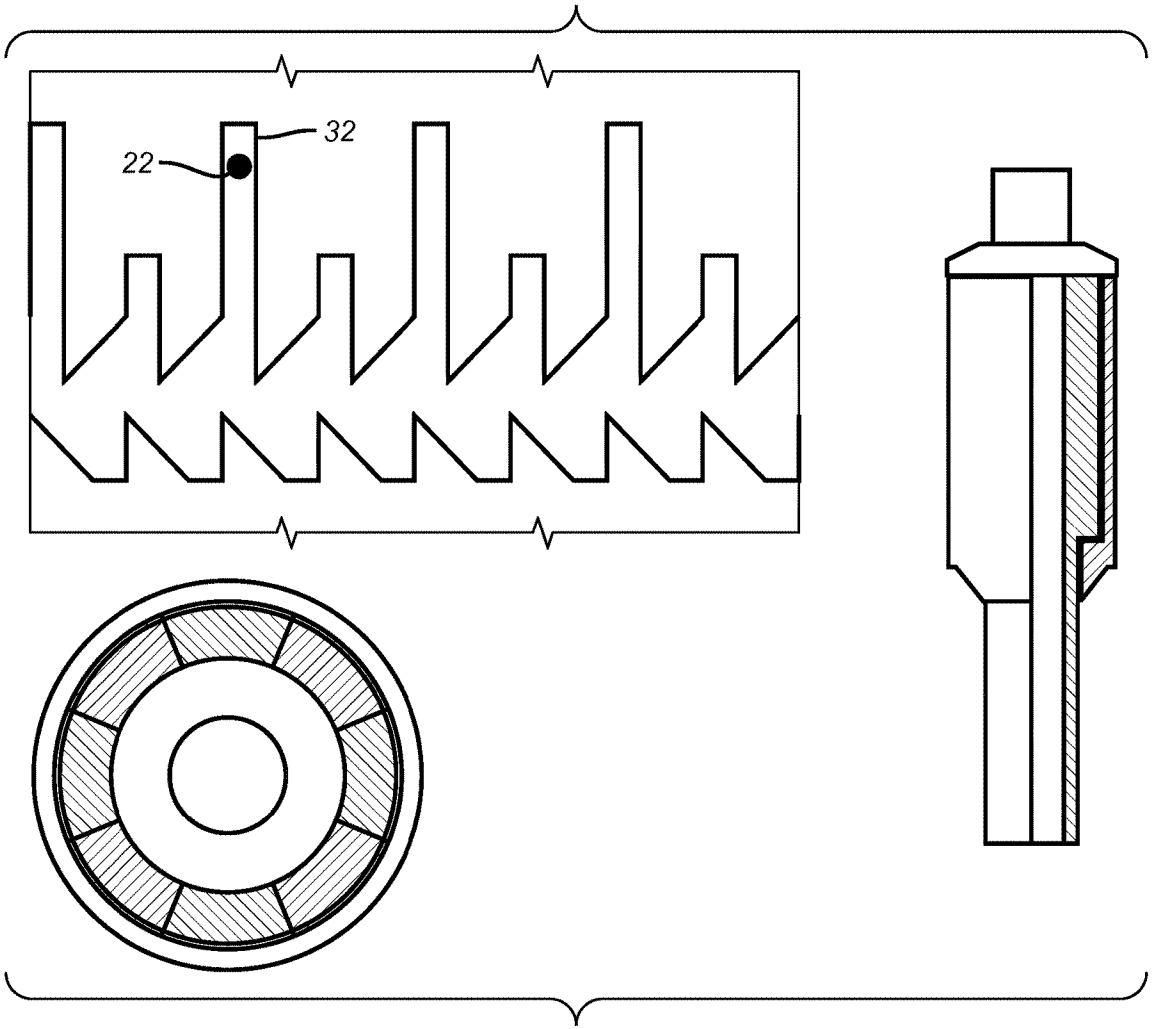
FIG. 10 is the view of FIG. 9 with weight set down and the indexing device in the low position.
Figure 11:
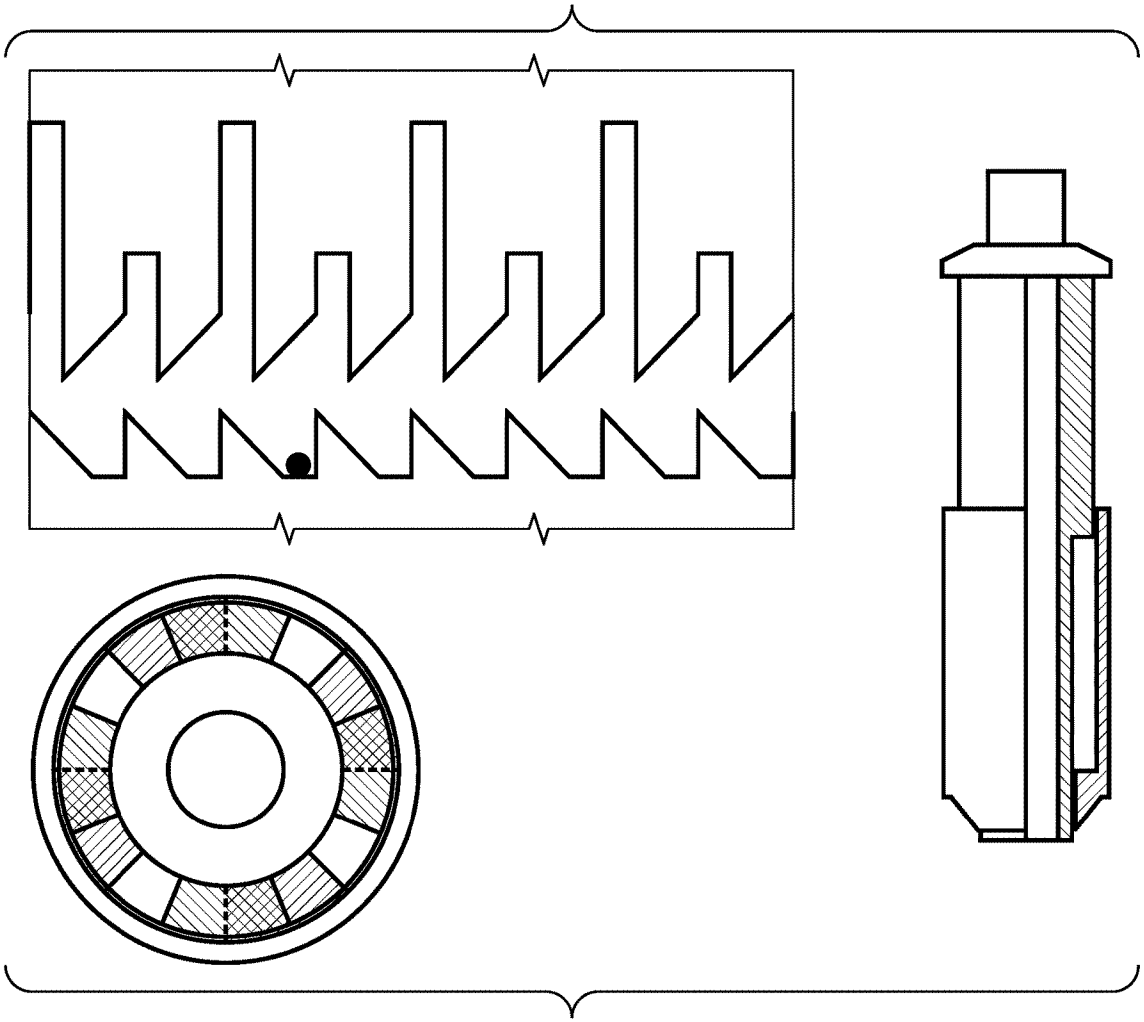
FIG. 11 is the view of FIG. 10 with the indexing device raised again.

FIG. 7 represents the spring 26 extended such as during running in which puts the pin 22 in one of the lower portions 28 of the continuous slot pattern 24. Setting down weight on the locator 10 brings the pin 22 to the next short upper slot 30 as shown in FIG. 8. On picking up again as in FIG. 9 the pin 22 is in the lower portion of the slot 28 and on setting down weight again the pin moves into a long slot 32 as shown in FIG. 10. At this point the extra travel of body 18 made possible by pin 22 moving in slot 32 allows operation of a downhole tool that is not shown and in the preferred case is a barrier valve associated with a production packer that is also not shown. What is shown in the FIGS. is the top of the polished bore receptacle 16 that is supported above the set production packer. In the case of a barrier valve the extra movement engages the operator for the barrier valve so that the ball can turn 90 degrees and open the valve or a sliding sleeve. FIG. 11 shows the subsequent picking up of the body 18 which then allows the mechanism that had opened the valve in FIG. 10 to close the valve on coming out through the polished bore receptacle 16. The tools that engage the operator for the barrier valve are not shown as they are well known to those skilled in the art.

Figure 5:
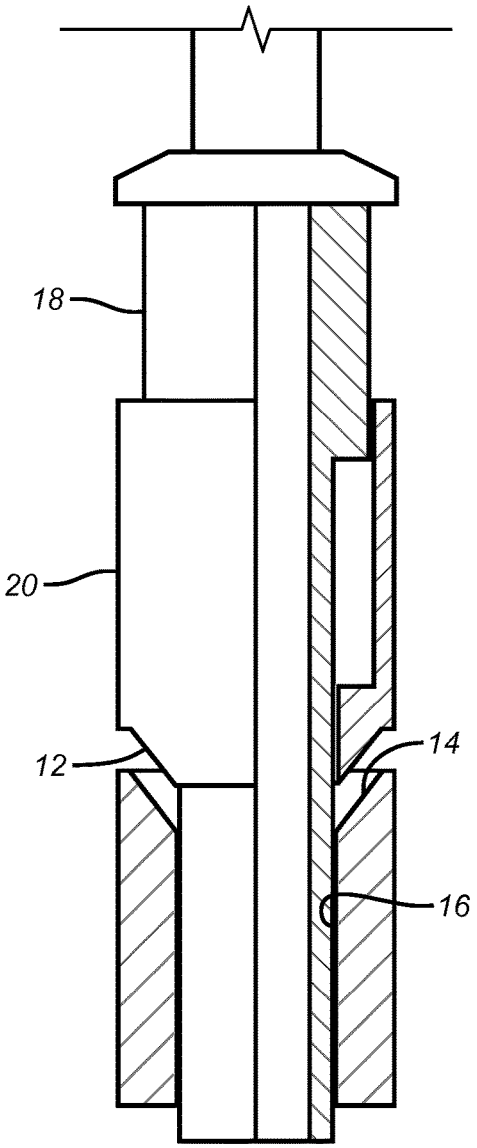
FIG. 5 is the view of FIG. 4 with the indexing device picked up.
Figure 6:
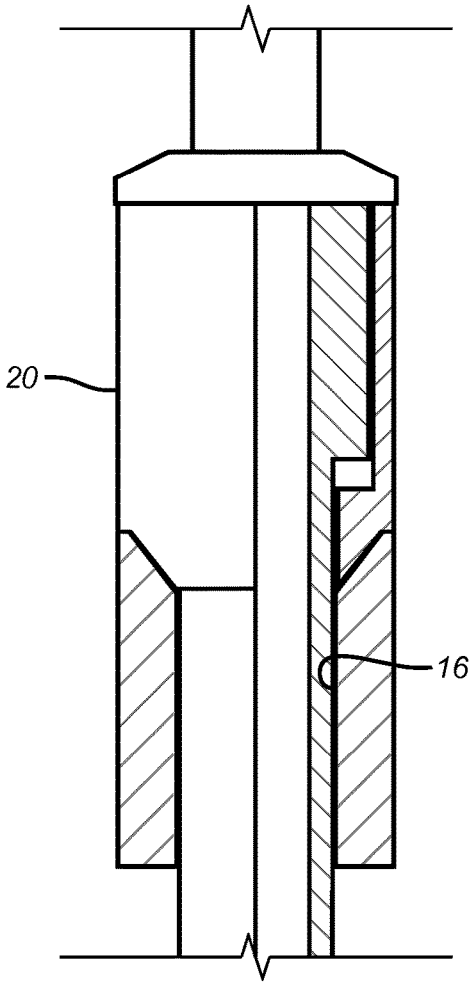
FIG. 6 is the view of FIG. 5 with the indexing device landed in the low landing position.

FIGS. 1-4 show bringing the outer housing 20 down on the travel stop 14 and setting down weight. The barrier valve (not shown) will not operate as the pin 22 will go into a short slot 30 as shown in FIG. 8. Picking up after the FIG. 4 position and into the FIG. 5 position gets the pin into a lower slot 28 as shown in FIG. 9 while setting down weight again as shown in FIG. 6 gets the extended reach needed by guiding pin 22 into a long slot 32 so that the operator of the tool downhole can be engaged and operated. In the preferred case the tool is a barrier valve associated with a production packer but could be other tools such as a sliding sleeve or some other type of valve to name a few examples. Picking up from the FIG. 6 position will then operate the tool in reverse and in the case of a barrier valve will shift the valve to close as the valve operator is engaged when coming out of the hole with the body 18 to close the barrier valve.

Those skilled in the art will appreciate that the objective of prevention of operation of a tool on initial landing of a string can be accomplished in other ways than a continuous j-slot as described in detail above. A single pin in an l-shaped slot or a slot with multiple turns can be used and can then be operated with a combination of setting down weight and rotation. Another alternative can be a variable volume chamber that is filled with an incompressible fluid and a metered outlet so that initial setting down will also not operate the subterranean tool but if the set down weight is maintained there would then be a predetermined time before sufficient travel has occurred to operate a tool such as a barrier valve. In another variation a variable volume reservoir can be isolated with a rupture disk to prevent continued movement after landing on a travel stop until enough set down weight is applied to build pressure to break the rupture disc. The objective in each case is to make sure that upon initial landing the tool to be operated is in fact not initially operated. Instead, it takes further action or movement of the associated string to get the barrier valve or the tool in question operated. In essence, there is a temporary mechanism or feature that prevents tool actuation on initial setting down weight but thereafter enables such operation by string manipulation, pressure application or some other means to change the amount of available movement so that the subterranean tool that previously was not operated with the initial landing can then be operated. This device is particularly useful if the string has to be cut by shear rams in an emergency and then allowed to fall with the tool operator located at the leading end of the falling string. With this tool, upon initial impact with the travel stop further movement of the components of the device is arrested so that, in the case of a barrier valve, there is no opening of the valve. The string can later be fished out with the barrier valve closed for an added safety feature.

The above description is illustrative of the preferred embodiment and many modifications may be made by those skilled in the art without departing from the invention whose scope is to be determined from the literal and equivalent scope of the claims below.

We claim:

1. A device for use on a tubular string for selectively engaging a travel stop in an existing string that supports a subterranean tool and for selective operation of the subterranean tool, comprising:

selectively relatively movable components, at least one of which further comprises a landing shoulder, said components, when run in, configured to prevent subterranean tool operation from said landing shoulder engaging said travel stop to break a free fall;

said components configured to move relatively or not at all on initial free fall contact of said landing shoulder to the travel stop to break said free fall of said landing shoulder such that the subterranean tool is not operated, said subterranean tool remaining operable after said initial free fall contact of said landing shoulder with said travel stop with subsequent gripping and manipulation of the dropped or severed tubular string with said landing shoulder on said travel stop, said free fall caused by emergency severing or dropping of said tubular string.

2. The device of claim 1, wherein:

said components are connected to each other with a j-slot mechanism.

3. The device of claim 1, wherein:

said components selectively assume a longer extension from said landing shoulder for subterranean tool operation.

4. The device of claim 1, wherein:

said landing shoulder engages the travel stop upon said components being moved from a surface location with the tubular string.

5. The device of claim 2, wherein:

said landing shoulder has to contact the travel stop a second time to operate the subterranean tool.

6. The device of claim 1, wherein:

the subterranean tool comprises a production packer with a barrier valve.

7. The device of claim 1, wherein:

said components are selectively relatively movable with axial motion.

8. The device of claim 7, wherein:

said components are selectively relatively movable with a combination of axial movement and rotation.

9. The device of claim 2, wherein:

said j-slot mechanism comprises a slot that extends up to 360 degrees.

10. The device of claim 9, wherein:

said j-slot mechanism comprises a biasing member acting on said components.

11. The device of claim 1, wherein:

said components define a variable volume containing an incompressible fluid and an orifice for escape of said fluid to regulate the rate of said relative movement to a predetermined rate.

12. The device of claim 1, wherein:

said components define a variable volume that is selectively sealed at an outlet with a breakable member that holds fluid therein until a predetermined force is applied to pressurize fluid in said volume to a predetermined pressure to break the breakable member for initiation of said relative movement.

13. The device of claim 1, wherein:

said landing shoulder has to be lifted off the travel stop and set on the travel stop a second time to operate the subterranean tool.

14. The device of claim 2, wherein:

said j-slot mechanism further comprises alternating short and long upper slot to limit axial extension of at least one of said components from said landing shoulder.

15. The device of claim 7, wherein:

the subterranean tool comprises a production packer with a barrier valve.

16. The device of claim 15, wherein:

said components are selectively relatively movable with axial motion.

17. The device of claim 16, wherein:

said components are selectively relatively movable with a combination of axial movement and rotation.

18. The device of claim 17, wherein:

said j-slot mechanism comprises a slot that extends up to 360 degrees.

19. The device of claim 18, wherein:

said j-slot mechanism comprises a biasing member acting on said components.

* * * * *